United States Patent [19]

Selby et al.

[11] 4,402,111

[45] Sep. 6, 1983

[54] CLOSURE PANEL HINGE WITH TORSION BAR

[75] Inventors: Donald A. Selby, Southfield; Leonard P. Silk, East Lansing, both of Mich.

[73] Assignee: General Motors Corporation, Detroit, Mich.

[21] Appl. No.: 312,402

[22] Filed: Oct. 19, 1981

[51] Int. Cl.[3] ..... E05F 1/12

[52] U.S. Cl. ..... 16/308; 16/361; 16/364

[58] Field of Search ..... 16/308, 361, 364, 360

[56] References Cited

U.S. PATENT DOCUMENTS 3,153,258 10/1964 Badura ..... 16/308 X
3,370,317 2/1968 Marchione ..... 16/308
4,069,550 1/1978 Silk et al. .

FOREIGN PATENT DOCUMENTS 1389466 4/1975 United Kingdom ..... 16/308

*Primary Examiner*—Werner H. Schroeder

*Assistant Examiner*—Andrew M. Falik

*Attorney, Agent, or Firm*—Charles E. Leahy

[57] ABSTRACT

The hinge for mounting a closure panel on a vehicle body includes a body bracket mounted on the vehicle body and having a cam surface and an elongated cam slot. A panel bracket is mounted on the closure panel and has a cam follower portion slidably bearing on the cam surface of the body bracket to define a first cam arrangement. A torsion bar has one end nonrotatably mounted on the vehicle body and the other end nonrotatably mounted on the panel bracket so that the torsion bar torsionally biases the panel bracket and closure panel to a normal pivotal position relative the vehicle body. The portion of the torsion bar mounted on a panel bracket extends slidably through the cam slot of the body bracket to define a second cam arrangement. The first and second cam arrangements are arranged relative one another whereby upon pivotal opening movement of the closure panel, the closure panel is bodily shifted to avoid interference of the closure panel with the vehicle body.

3 Claims, 4 Drawing Figures

CLOSURE PANEL HINGE WITH TORSION BAR

The invention relates to closure panel hinges and more particularly to a vehicle body deck lid hinge.

BACKGROUND OF THE INVENTION

Motor vehicle bodies have a luggage compartment which is closed by a deck lid. The deck lid is hinged to the vehicle body at its forward end for pivotal movement between open and closed positions. A stationary panel of the vehicle body spaces the luggage compartment opening and the deck lid away from the rear window glass so that there is no problem of the deck lid forward edge coming into interference with the rear window glass during opening movement of the deck lid.

It would be desirable to have the forward edge of the deck lid closely juxtaposed to the rear window glass without the interposition of a stationary panel in order to provide a manufacturing and weight advantage as well as satisfy modern size and styling criteria.

U.S. Pat. No. 4,069,550, issued Jan. 24, 1978 to Leonard P. Silk et al, discloses a closure panel hinge which prevents interference of the closure panel with the vehicle body structure by providing bodily shifting movement of the closure panel during opening movement. The present invention provides an improvement in the structure of the prior invention by utilizing a torsion bar which acts to bias the closure panel to the open position as well as cooperating to define a cam arrangement which contributes to effecting bodily shifting movement of the closure panel during such pivotal movement.

SUMMARY OF THE INVENTION

According to the present invention, the hinge for mounting a closure panel on a vehicle body includes a body bracket mounted on the vehicle body and having a cam surface and an elongated cam slot. A panel bracket is mounted on the closure panel and has a cam follower portion slidably bearing on the cam surface of the body bracket to define a first cam arrangement. A torsion bar has one end nonrotatably mounted on the vehicle body and the other end nonrotatably mounted on the panel bracket so that the torsion bar torsionally biases the panel bracket and closure panel to a normal pivotal position relative the vehicle body. The portion of the torsion bar mounted on a panel bracket extends slidably through the cam slot of the body bracket to define a second cam arrangement. The first and second cam arrangements are arranged relative one another whereby upon pivotal opening movement of the closure panel, the closure panel is bodily shifted to avoid interference of the closure panel with the vehicle body.

DESCRIPTION OF THE DRAWINGS

These and other objects, feature and advantages of the invention will become apparent upon consideration of the specification and the appended drawings wherein.

DESCRIPTION OF THE PREFERRED EMBODIMENT

Figure 1:
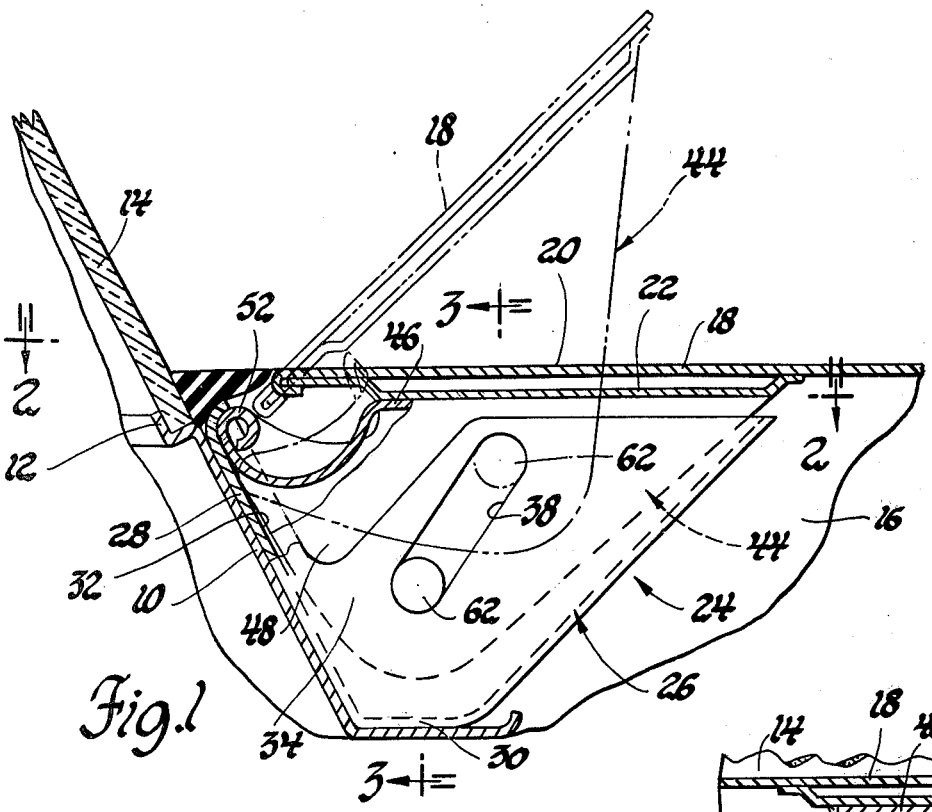
FIG. 1 is a side elevation view of a closure panel hinge according to the invention showing a solid line indicated closed position of the closure panel and a phantom line indicated open position of the closure panel.

Referring to FIG. 1, there is shown a fragmentary view of the motor vehicle body. The vehicle body includes stamped steel body member 10 having a flange 12 at its upper edge which supports a rear window glass 14. The body member 10 and rear window glass 14 cooperate to define the forward wall of a compartment opening providing access to a luggage compartment 16. A deck lid 18 comprised of an outer panel 20 and an inner panel 22 is hingedly mounted on the body member 10 for pivotal movement between open and closed positions by a pair of hinges, one of which is generally indicated at 24.

Figure 3:
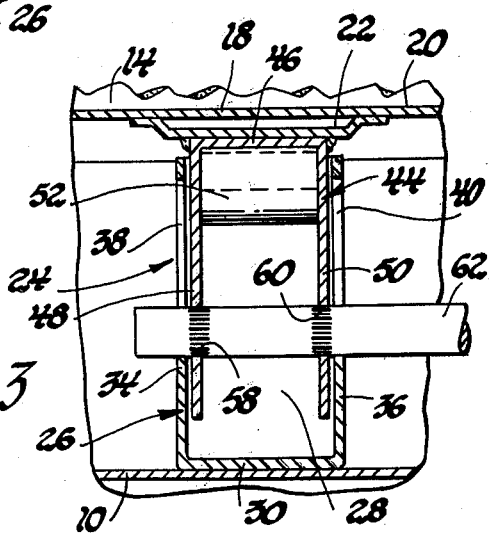
FIG. 3 is a sectional view taken in the direction of arrows 3—3 of FIG. 1.
Figure 4:
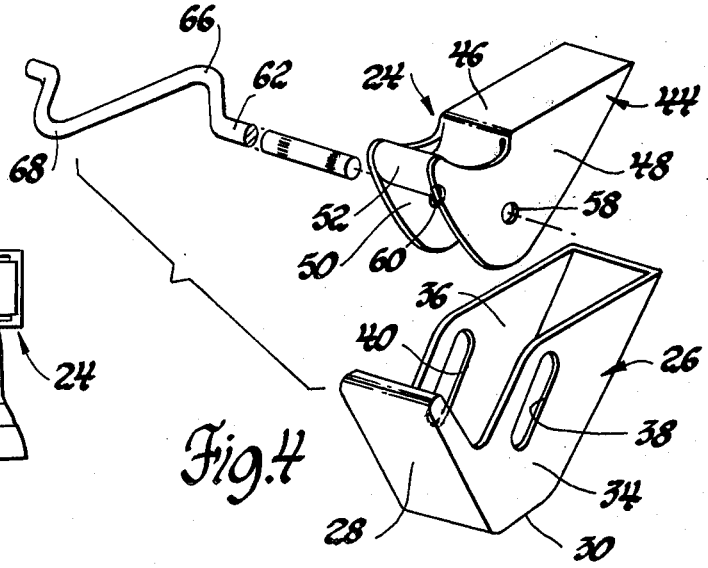
FIG. 4 is an exploded perspective view showing the body bracket, the panel bracket and the torsion bar which comprise the hinge of this invention.

As best seen in FIGS. 3 and 4, the hinge 24 includes a body bracket 26. The body bracket 26 is a sheet metal stamping and includes base walls 28 and 30 which rest upon the panel member 10 and are suitably attached thereto as by welding. The inner face of the base wall 28 provides a cam surface 32. The body bracket 26 also includes laterally spaced apart walls 34 and 36 which respectively have elongated cam slots 38 and 40 provided therein.

The hinge 24 also includes a panel bracket 44. As best seen in FIGS. 3 and 4, the panel bracket 44 is a steel stamping and includes a base wall 46 which is welded or otherwise suitably attached to the deck lid inner panel 22. The panel bracket 44 has laterally spaced downward extending legs 48 and 50 which are juxtaposed with the walls 34 and 36 of the body bracket 26. The base wall 46 is curled over at its end and cooperates with the end of the legs 48 and 50 to define a cam follower portion 52 which bears upon the cam surface 32 to provide a first cam arrangement between the body bracket and panel bracket. Aligned apertures 58 and 60 are provided in the legs 48 and 50.

The hinge 24 also includes a torsion bar 62. The torsion bar 62 extends through the aligned apertures 58 and 60 of the panel bracket 44 and has an interference fit therewith so that the torsion bar 62 is nonrotatably attached to the panel bracket 44. The torsion bar 62 also extends slidably through the cam slots 38 and 40 of the body bracket 26 to provide a second cam arrangement between the body bracket and panel bracket.

Figure 2:
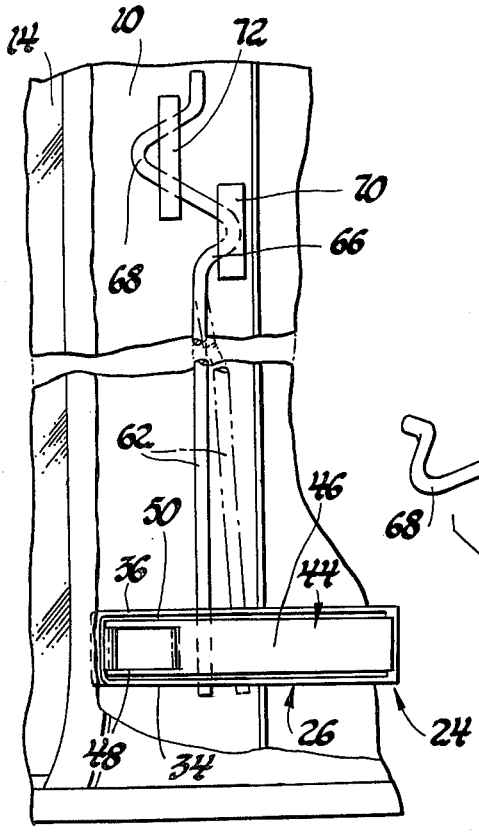
FIG. 2 is a sectional view taken in the direction of arrows 2—2 of FIG. 1.

Referring to FIG. 2, it is seen that the end of the torsion bar 62 has convolutions 66 and 68 which are nonrotatably anchored on the body member 10 by anchor straps 70 and 72.

Referring to FIG. 1, it is seen that the deck lid 18 is shown in the closed position in which the cam follower portion 52 of the panel bracket 44 rests at the top of the cam surface 32 of the body bracket 26 and the torsion bar 62 rests at the bottom of the cam slots 38 and 40.

When the deck lid 18 is unlatched for movement to the phantom line indicated open position of FIG. 1, the torsion bar 62 biases the panel bracket 44 and the deck lid 18 in the upward direction. The path of such motion is determined by the travel of the panel bracket cam follower portion 52 along the body bracket cam surface 32 and by the travel of the torsion bar 62 along the elongated cam slots 38 and 40. As seen in FIG. 2, the torsion bar 62 flexes from the solid line indicated position to the phantom line indicated position to accommodate its movement along the cam slots 38 and 40. Comparing the solid line closed and phantom line open positions of FIG. 1, it is seen that the first and second cam arrangements cooperate to bodily shift the pivot axis of the deck lid 18 rearwardly and upwardly in order to control the motion of the forwardmost edge of the deck lid 18 such that there is no interference between the deck lid and the window panel 14.

On closing movement of the deck lid 18 against the rotary bias of the torsion bar 62 the first and second cam arrangements restore the elements of the hinge to the solid line indicated position of FIG. 1.

Thus, it is seen that the invention provides a new and improved closure panel hinge which is particularly suited for luggage compartment deck lids in motor vehicles but could be equally well employed as vehicle body hood hinge or in other applications.

The embodiments of the invention in which an exclusive property or privilege is claimed are defined as follows:

1. A hinge for mounting a closure panel on a body panel comprising:

a body bracket mounted on the body panel;

a panel bracket mounted on the closure panel;

a torsion bar having one end attached to one of the panels and the other end attached to the bracket mounted on the other panel so that the torsion bar torsionally biases the closure panel to a normal position relative the body panel;

first cam means acting between the body bracket and the panel bracket including a cam surface on one of the brackets and a cam follower on the other bracket; and a cam slot provided in the bracket mounted on the one panel having the one end of the torsion bar attached thereto, said torsion bar extending through the cam slot and coacting therewith to define a second cam means whereby upon pivotal movement of the closure panel the first and second cam means cooperate to bodily shift the closure panel to avoid interference of the closure panel with the body panel.

2. A hinge for mounting a closure panel on a vehicle body comprising:

a body bracket mounted on the vehicle body and having a cam surface and an elongated cam slot;

a panel bracket mounted on the closure panel and having a cam follower portion slidably bearing on the cam surface of the body bracket to define a first cam means;

a torsion bar having one end nonrotatably mounted on the vehicle body and the other end nonrotatably mounted on the panel bracket so that the torsion bar torsionally biases the panel bracket and closure panel to a normal pivotal position; and said torsion bar mounted on the panel bracket extending slidably through the cam slot of the body bracket to define a second cam means, said first and second cam means being arranged relative one another whereby upon opening movement of the closure panel the closure panel is bodily shifted to avoid interference of the closure panel with the body panel.

3. A hinge for mounting a closure panel for pivotal and bodily shifting movement between open and closed positions on a vehicle body comprising:

a body bracket mounted on the vehicle body;

a panel bracket mounted on the closure panel;

a torsion bar having one end nonrotatably mounted on the vehicle body and the other end nonrotatably mounted on the panel bracket so that the torsion bar biases the panel bracket and closure panel to the normal open or closed position; and a first cam means and a second cam means, each cam means acting between the body bracket and the panel bracket and adapted to effect bodily shifting movement of the panel bracket relative the body bracket during pivotal movement of the closure panel between the open position and the closed position, one of said cam means including an elongated cam slot in the body bracket and said torsion bar extending slidably through the cam slot for migration along the cam slot during pivotal movement of the panel bracket relative the body bracket.

* * * * *